United States Patent [19]

Abe

[11] 4,282,677

[45] Aug. 11, 1981

[54] AMBULATORY WORKER TOY

[75] Inventor: Yoichi Abe, Funabashi, Japan

[73] Assignees: Toybox Corporation; Wamy Corporation, both of Japan

[21] Appl. No.: 143,639

[22] Filed: Apr. 25, 1980

[30] Foreign Application Priority Data

Apr. 17, 1979 [JP] Japan ..... 54-51746[U]

[51] Int. Cl.[3] ..... A63H 5/00; A63H 11/00

[52] U.S. Cl. ..... 46/118; 46/120; 46/150

[58] Field of Search ..... 46/150, 119, 118, 120, 46/149, 266, 265, 264, 117

[56] References Cited

U.S. PATENT DOCUMENTS

| | | | |
|---|---|---|---|
| 2,147,215 | 2/1939 | Price | 46/150 |
| 2,667,719 | 2/1954 | Edwardson | 46/150 |
| 2,881,559 | 4/1959 | Glass | 46/116 X |
| 3,660,931 | 5/1972 | Gardel et al. | 46/150 X |
| 3,846,934 | 11/1974 | Thorn et al. | 46/118 X |
| 3,851,418 | 12/1974 | Barlow et al. | 46/120 |

FOREIGN PATENT DOCUMENTS

| | | | |
|---|---|---|---|
| 2356442 | 1/1978 | France | 46/150 |
| 1077099 | 7/1967 | United Kingdom . | |
| 1333314 | 10/1973 | United Kingdom . | |

*Primary Examiner*—Robert Peshock
*Assistant Examiner*—Mickey Yu
*Attorney, Agent, or Firm*—Staas & Halsey

[57] ABSTRACT

An ambulatory worker toy having a wind-up spring motor within a housing which includes a head casing movably mounted on a torso casing from which fixed and movable arm members extend. Two movably mounted leg members are connected to the spring motor via an ambulatory transmission mechanism to periodically raise and shift the leg members to propel the toy sideways in a walking motion. A tool movement transmission mechanism driven by the spring motor moves the movable arm member and a toy broom attached thereto to simulate a sweeping action. Finally, an oscillatory transmission mechanism driven by the spring motor periodically pumps an internal whistle mechanism and moves the head casing in simulation of a whistling worker. The net effect of the various transmission mechanisms is to present a toy which is powered by a single spring motor but which nevertheless simulates a sweeping worker which whistles as it walks.

9 Claims, 8 Drawing Figures

FIG. 3.
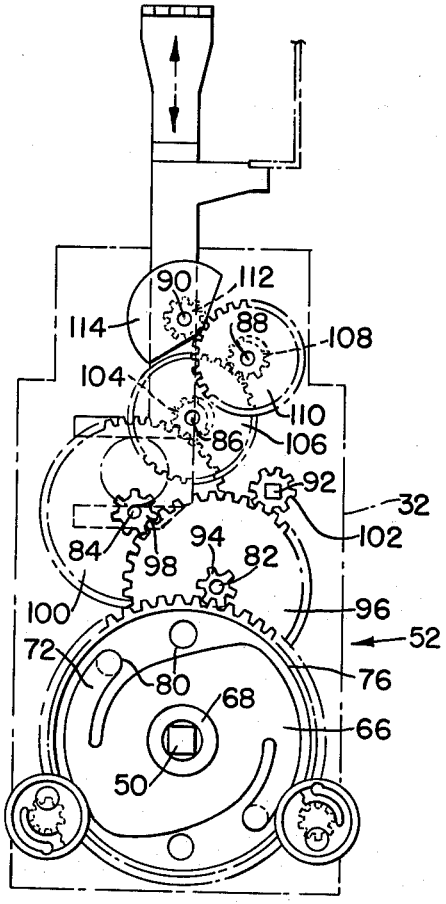
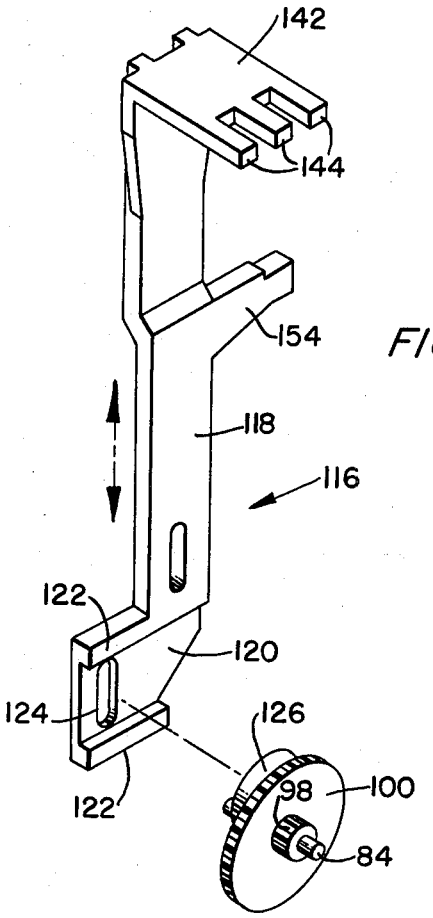
FIG. 4.
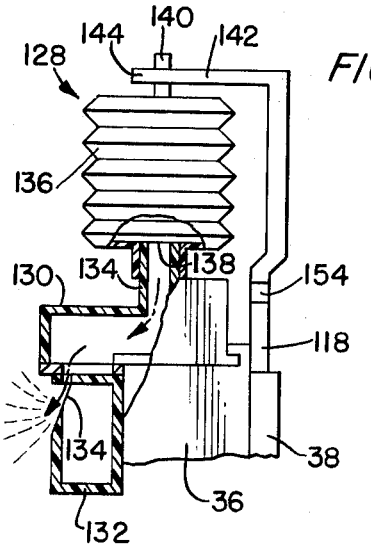
FIG. 5.
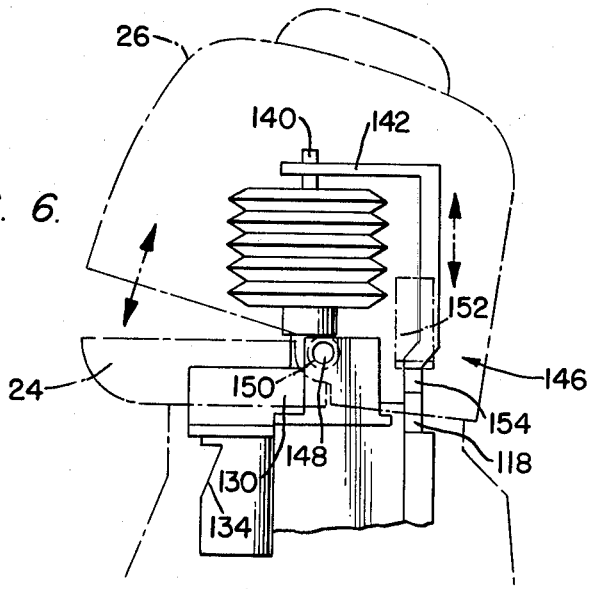
FIG. 6.

AMBULATORY WORKER TOY

BACKGROUND AND SUMMARY OF THE INVENTION

The present invention relates to an ambulatory worker toy, and in particular to a wind-up toy robot which ambles along sideways as it wields a toy broom, whistling as it works. The toy includes a head casing pivotably mounted above a torso casing from which extend fixed and movable arm members. Two leg members movably mounted on a chassis contained within the toy are connected via an ambulatory transmission mechanism to a spring motor mounted within the chassis, thereby periodically lifting and moving foot members mounted at the ends of the leg members to propel the toy sideways along a line connecting the foot members. Additionally, a tool movement transmission mechanism operatively connects the spring motor to the movable arm member and broom, while an oscillatory transmission mechanism is operatively connected to the spring motor to generate oscillations for periodically moving the head casing and activating a whistle mechanism mounted on the chassis.

BRIEF DESCRIPTION OF THE DRAWINGS

FIG. 3 is a front view of portions of the spring motor within the internal chassis, showing how the various transmission mechanisms are operatively connected to the spring motor;

FIG. 4 is an exploded perspective view of the oscillatory transmission mechanism which produces the oscillations for driving the whistle mechanism and for oscillating the head casing;

FIG. 5 is a side view, partially in section, illustrating the whistle mechanism;

FIG. 6 is a side view illustrating the oscillatory transmission mechanism oscillating the head casing and driving the whistle mechanism;

DETAILED DESCRIPTION OF THE PREFERRED EMBODIMENT

Figure 1:
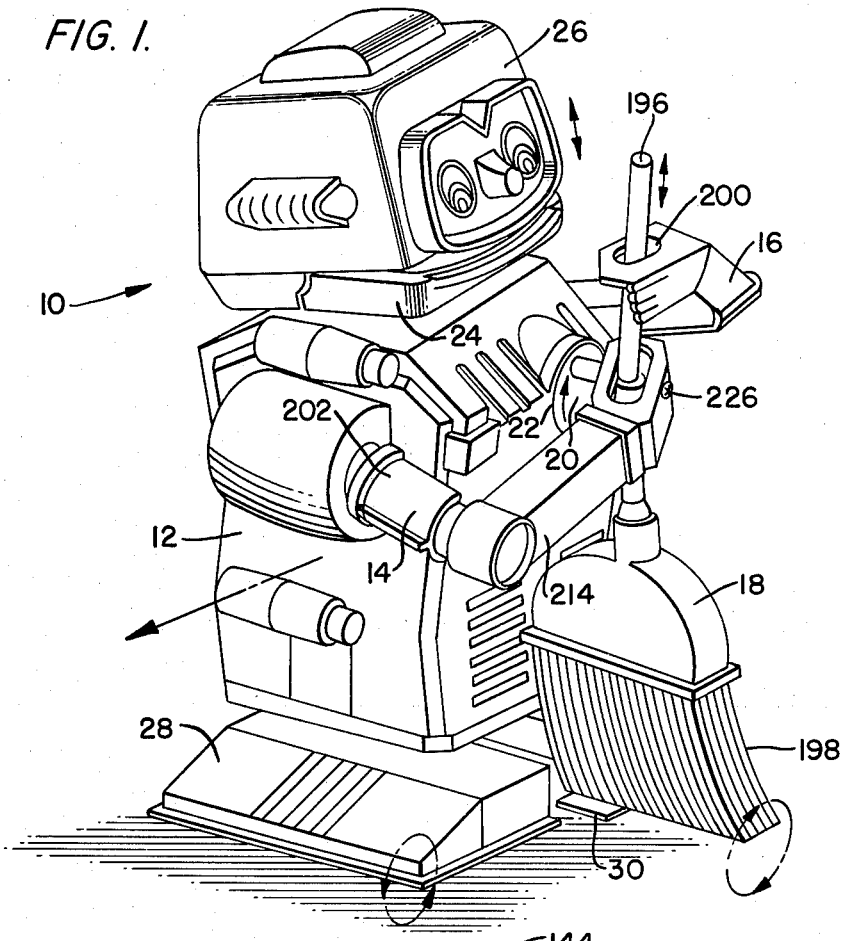
FIG. 1 is a perspective view of the ambulatory worker toy, illustrating generally the movement of the foot members and resulting sideways movement of the toy, the movement of the broom, and the periodic rocking of the head casing.

The ambulatory worker toy 10 of the present invention is illustrated in FIG. 1 in the form of a toy robot having a torso casing 12 from which arm members 14 and 16 extend to clasp a tool such as broom 18, which is movably attached to rotatable element 20 extending through opening 22 in torso casing 12. Jaw portion 24 is molded from the plastic forming torso casing 12, and head casing 26 is movably mounted above torso casing 12 so that the worker toy will appear to be opening its mouth when casing 12 moves with respect to casing 26. Foot members 28 and 30 movably extend from torso casing 12 and are coupled to a power source such as a spring motor contained within torso casing 12 so that toy 10 shuffles along sideways as it sweeps and whistles as it works in the manner to be described in the following paragraphs.

Figure 2:
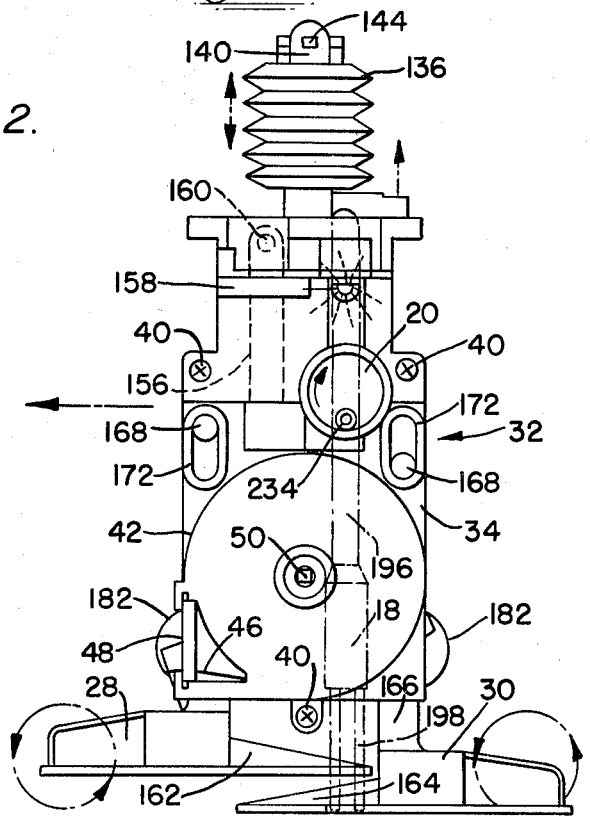
FIG. 2 is a front view of the toy with the casings removed, illustrating generally the pumping of the bellows of the whistle mechanism, the rotatable element of the tool movement transmission mechanism which moves the broom and movable arm member, and the movement of the foot members resulting from the ambulatory transmission mechanism.

Chassis 32, illustrated in FIG. 2, is positioned within torso casing 12 and includes top chassis member 34, middle chassis member 36 (see FIG. 5), and bottom chassis member 38 (see FIG. 5), all joined as a unitary structure by screws 40. In order to simplify the following description various holes, flanges, etc., provided on chassis 32 have not been illustrated in the drawings, since these features will be readily apparent to those skilled in the art.

With continuing reference to FIG. 2, top chassis member 34 includes circular cavity 42 to accommodate spring 44 (see FIG. 7) of the spring motor. One end 46 of spring 44 is secured to chassis 32 by being attached to metal clip 48 which is suitably mounted on chassis member 34. Square shaft 50 rotatably extends through chassis 32, which has openings provided for this purpose.

Figure 7:
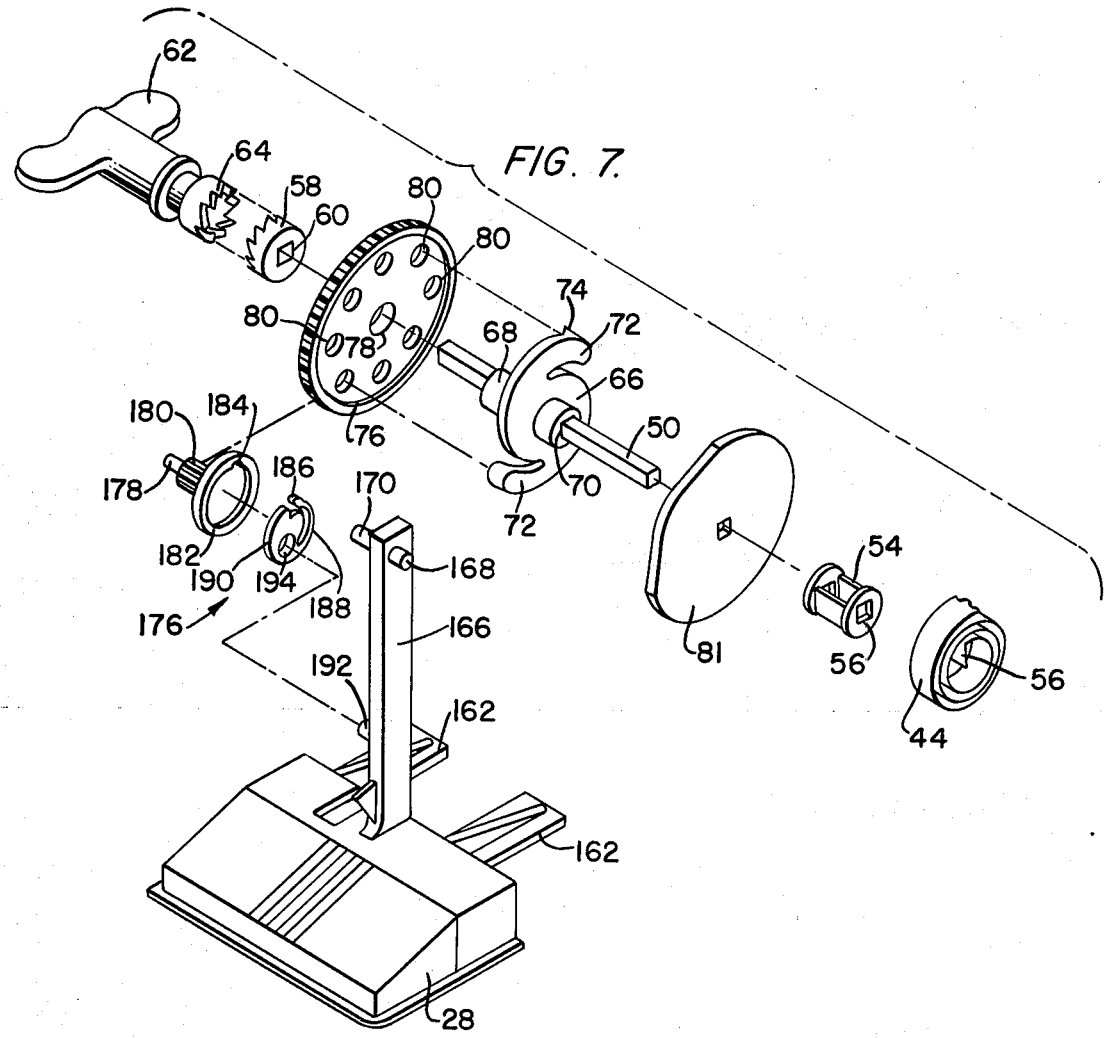
FIG. 7 is an exploded perspective view of a portion of the spring motor and half of the ambulatory transmission mechanism illustrating how one leg member is coupled to the spring motor.

Referring next to FIGS. 3 and 7, spring motor 52 which powers toy 10 will now be described. Metal clip 54 has square openings 56 at either end thereof through which shaft 50 extends. End 56 of spring 44 is attached to clip 54 and it will be apparent that shaft 50 can be manually rotated to store energy in spring 44 in order to power toy 10. To accomplish this winding function rachet element 58 having square opening 60 is mounted on shaft 50. Key element 62 extends through a suitably positioned opening in the back torso casing 12 and is provided with toothed portions 64 which engages the teeth of element 58 when key element 62 is rotated in one direction but not when element 62 is rotated in the other direction. This safety feature insures that spring motor 52 will not be damaged by an attempt to wind it in the wrong direction.

With continuing reference to FIGS. 3 and 7, gear engaging element 66 includes a central cylinder 68 having a square opening 70 therein to accommodate shaft 50 and two arms 72 each having a sloping projection 74 at the end thereof. Large gear 76 is provided with a central opening 78 through which cylinder 68 rotatably extends and a plurality of additional openings 80 positioned to accommodate projections 74. It will be apparent to those skilled in the art that sloping projections 74 allow element 66 to rotate with respect to gear 76 when key element 62 is being wound, but lock element 66 to gear 76 after the winding operation is completed so that spring 44 may convey the power stored therein to gear 76. Shield element 81 is disposed on shaft 50 to retain spring 44 within cavity 42.

With continuing reference to FIG. 3, shafts 82, 84, 86, 88, and 90 are journalled for rotation within chassis 32. Gears 94 and 96 are fixed to shaft 82, with gear 94 meshing with gear 76. Gears 98 and 100 are fixed to shaft 84, with gear 98 meshing with gear 96. Gears 104 and 106 are fixed to shaft 86, with gear 104 meshing with gear 100. Gears 108 and 110 are fixed to shaft 88, with gear 108 meshing with gear 106. Finally, gear 112 and eccentric weight 114 are fixed to shaft 90, with gear 112 meshing with gear 110. It will be apparent to those skilled in the art that rotation of gear 76 is conveyed to gear 100 via gears 94, 96, and 98. The rotary motion is further conveyed to eccentric weight 114, which stabilizes spring motor 52, via gears 104, 106, 110, 108, and 112.

Referring next to FIG. 4, oscillatory transmission mechanism 116 for deriving oscillatory motion from spring motor 52 will now be described. Oscillatory element 118 has foot 120 at the bottom thereof, with flanges 122 positioned at either side of foot 120. Element 118 is slidably mounted within chassis 32, which is provided with a recess to guide the motion of element 118. Slot 124 is provided in foot 120 to allow shaft 84 to extend therethrough to a mounting hole in bottom chassis member 38. Cylinder 126 is eccentrically fixed on gear 100, so that cylinder 126 will encounter one flange 122 and then the other flange 122 as gear 100 rotates, thereby oscillating element 118.

With reference next to FIGS. 4 and 5, it will be apparent that oscillatory transmisson mechanism 116 couples spring motor 52 to whistle mechanism 128. Whistle element 130 is provided with whistle chamber 132 having a whistle vent 134 therein and an air input port 134 pneumatically coupled to chamber 132. Element 130 is fixedly mounted on top of chassis 32 by conventional means such as screws. Plastic bellows 136 has at one end thereof an opening 138 sealingly engaged with air input port 134 and at the other end thereof a plastic handle 140 having an opening (not illustrated) therein. Whistle activating arm 142 extends from oscillatory element 118 and is provided with fingers 144, the central one of which extends through the opening in handle 140. It will be apparent to those skilled in the art that oscillatory transmission mechanism 116 moves whistle activating arm 140 and fingers 144 thereof up and down, thereby forcing air into and out of bellows 136. Whistle element 130 emits periodic bursts of sound as a result.

Turning now to FIGS. 4 and 6, it will be apparent that oscillatory transmission mechanism 116 also couples spring motor 52 to head moving mechanism 146. A mounting peg 148 (only one of which is illustrated in FIG. 6) extend from the sides of whistle element 130. Pegs 148 extend into corresponding openings 150 provided inside head casing 26, thereby pivotably mounting casing 26. Metal flange 152 is mounted inside casing 26 in a suitable manner such as by a screw. Flange 152 is positioned to periodically engage head moving arm 154 as oscillatory element 118 moves up and down, thereby pivoting head casing 26 about mounting posts 148 to periodically open the mouth of toy 10 in synchronism with the whistles emitted from whistle mechanism 128.

While a head moving mechanism 146 has been described for moving head casing 26 back and forth, it will be apparent to those skilled in the art that alternative head moving mechanisms could be employed if head casing 26 were pivoted to move from side to side instead of back and forth. In the latter situation jaw portion 24 would be made of the plastic forming head casing 26 instead of the plastic of torso casing 12. Moreover it would be convenient in this situation to provide mounting posts 148 within head casing 26 and openings 150 for receiving these posts on torso casing 12. A second oscillatory element 156 (partially illustrated using dotted lines in FIG. 2 to emphasize that it is employed as part of a second embodiment) guided by bracket 158 provided on chassis 32 could movably extend into cavity 42, with a foot having a slot therein projecting to the region of shaft 82 of spring motor 52. This slot could be engaged by an eccentrically mounted shaft extending from an element mounted on shaft 82, so that the rotary motion of shaft 82 would be converted to oscillatory motion of second oscillatory element 156. Opening 160 could then be provided at the end of element 156 to accommodate a peg extending from the interior of head casing 26 in order to pivot casing 26 from side to side.

With reference next to FIGS. 2 and 7, two stabilizing projections 162 extend from foot member 28, while one stabilizing projection 164 extends from foot member 30 between the two projections 162 of foot member 28. The purpose of these stabilizing projections is, of course, to provide stability when toy 10 is "walking." Each of the foot members 28 and 30 is attached at the end of a leg member 166 having posts 168 and 170 extending from the top thereof. Posts 168 and 170 are used for slidably mounting leg members 166 allowing them to be moved within vertically disposed slots in chassis 32. To this end, top chassis member 34 is provided with slots 172 to slidably receive posts 168, while middle chassis member 36 is provided with similar slots 174 (not illustrated) for receiving posts 170. It will be apparent that top and middle chassis members 34 and 36 are spaced apart to allow leg members 166 to be mounted between them, and moreover that the spacing between these chassis members provides openings in the sides of chassis 32 allowing each foot member to be pivoted outward to a small extent around the axis provided by posts 168 and 170. In short, leg members 166 having foot members 28 and 30 at the end thereof are movably mounted on chassis 32 in a manner which allows both angular movement of the legs 166 and vertical movement of the top ends of legs 166.

With continuing reference to FIGS. 2 and 7, ambulatory transmission mechanism 176 for coupling spring motor 52 to leg members 166 will now be described. Shafts 178 having gears 180 and recessed turntables 182 attached thereto are journalled for rotation in chassis 32 with turntables 182 being disposed between top and middle chassis members 34 and 36 and with gears 180 meshing with gear 76. Recessed turntables 182 have notches 184 in the recessed portions thereof to accommodate pegs 186 at the end of arms 188 extending from elements 190. It will be apparent that when elements 190 are inserted into the recessed portions of turntables 182, pegs 186 will mate with notches 184 to secure elements 190 to turntables 182 so that pegs 192 extending from leg members 166 may be movably inserted into openings 194 in elements 190 so that pegs 192 will undergo a circular motion as shafts 178 rotate. That is, the rotary motion of gear 76 is conveyed via gears 180 and turntables 182 to elements 190, and this motion is further conveyed via pegs 192 movably inserted into openings 194 to leg members 166, which are mounted to undergo a combination of angular motion and vertical displacement in the manner previously described. It will also be apparent that foot members 28 and 30 attached at the ends of leg members 166 undergo a sequenced progression involving both vertical oscillations and horizontal oscillations as elements 190 rotate. This combination of movements is illustrated in FIG. 2, along with the resulting ambulatory motion as foot members 28 and 30 shuffle the mechanism along. It will be noted that this ambulatory motion is sideways, that is, along a line generally connecting the two foot members 28 and 30, rather than forward.

Figure 8:
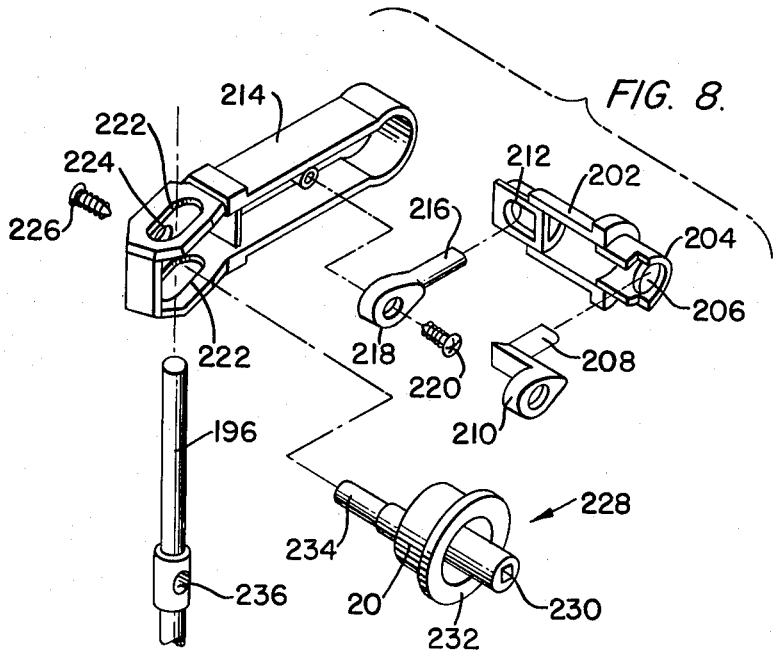
FIG. 8 is an exploded perspective view illustrating how a portion of the tool movement transmission mechanism is coupled to the broom and the moveable arm member.

Turning next to FIGS. 1 and 8, broom 18 is provided with handle 196 and with resilient plastic bristles 198, which are preferably curved in the manner illustrated to strengthen the impression that worker toy 10 is busily sweeping. Arm member 16 is fixedly attached to torso casing 12 in a suitable manner, such as by a screw, and is provided with opening 200 at the end portion thereof through which handle 196 freely extends. The other arm member 14 is preferably formed of articulated segments, FIG. 8 illustrating the preferred structure. In FIG. 8, upper arm segment 202 is provided with portion 204 which extends through a suitable opening in torso casing 12. Portion 204 is provided with opening 206 through which finger 208 of mounting element 210 extends, element 210 being mounted inside torso casing 12 in a suitable manner such as by a screw. The remaining end of upper arm segment 202 is also provided with an opening 212 extending into forearm segment 214. Finger 216 of mounting element 218 extends through opening 212 to loosely join segments 202 and 214, element 218 being secured to segment 214 by screw 220. The hand portion of segment 214 is provided with slots 222 through which handle 196 extends and with hole 224 for accommodating screw 226.

With reference next to FIGS. 1, 3, and 8, tool movement transmission mechanism 228 for coupling spring motor 52 to broom 18 will now be described. Square shaft 92 is journalled for rotation within chassis 32, with the end of shaft 92 extending out of chassis 32 so that it may be fitted into square opening 230 of rotatable element 20. Gear 102 is fixed to shaft 92 and meshes with gear 76. Rotatable element 20 is provided with flange 232 to keep element 20 from falling out of opening 22 and with offset peg 234, which has a threaded screw hole in the end thereof. Screw 226 extends through hole 224 and through hole 236 in handle 196 to the screw hole in the end of peg 234, thereby movably mounting arm member 14 and broom 18 to peg 234. It will be apparent to those skilled in the art that the rotary motion is conveyed from spring motor 52 via gear 102, shaft 92, and element 20 to arm member 14 and broom 18, which accordingly undergoes a sweeping motion.

The overall operation of the entire toy can now be described. Spring motor 52 drives oscillatory transmission mechanism 116, which in turn drives whistle mechanism 128 and head moving mechanism 146. Similarly, ambulatory transmission mechanism 176 couples spring motor 52 to leg members 166 having foot members 28 and 30 at the ends thereof, producing a sideway shuffling. Finally, tool movement transmission mechanism 228 couples spring motor 52 to broom 18, so that ambulatory worker toy 10 appears to sweep as it shuffles along, whistling as it works.

What is claimed is:

1. An ambulatory toy, comprising:

a chassis;

two leg members each having a foot member mounted at the bottom end thereof, the top end of each leg member being movably mounted on said chassis;

a power source mounted on said chassis, said power source including a rotatable gear, the axis of said gear being substantially perpendicular to a line connecting said foot members;

ambulatory transmission mechanism means operatively connecting said leg members to said power source for periodically moving said leg members vertically and angularly to propel said chassis sideways along a line connecting said foot members, said ambulatory transmission mechanism means including two pegs, each peg being affixed to a corresponding leg member between the top and bottom ends thereof, and two corresponding rotatably mounted elements operatively connected to said gear at different points on the periphery thereof, each rotatably mounted element having an offset hole therein to receive the corresponding peg, the axis of rotation of each rotatably mounted element being substantially perpendicular to a line connecting said foot members.

2. The ambulatory toy of claim 1, wherein said chassis has vertically disposed slots therein corresponding to each leg member, and wherein the top end of each leg member is movably mounted on said chassis by pegs movably extending into the vertically disposed slots.

3. The toy of claim 1, wherein said chassis is mounted in a torso casing having a first arm member movably mounted thereon, and further comprising a toy tool operatively connected to said first arm member and tool movement transmission mechanism means operatively connecting said power source and said toy tool for moving said tool.

4. The toy of claim 3, wherein said toy tool has a handle with a hole therein and wherein said tool movement transmission mechanism means comprises a rotatably mounted element operatively connected to said power source, said rotatably mounted element having an offset peg projecting therefrom and extending through the hole in said handle.

5. The toy of claim 5, wherein said toy tool is a toy broom having a plurality of resilient bristles extending therefrom, and further comprising a second arm member fixedly attached to said torso casing and having an opening in the hand end thereof through which the handle of said toy broom movably extends.

6. The toy of claim 1, further comprising a whistle element mounted on said chassis, a bellows pneumatically connected to said whistle element, and oscillatory transmission mechanism means operatively connecting said power source and said bellows for pumping said bellows to excite said whistle element.

7. The toy of claim 6, further comprising a pivotably mounted head casing, and wherein said oscillatory transmission mechanism further comprises means for pivoting said head casing.

8. An ambulatory toy, comprising:

a torso having a first arm member movably mounted thereon;

a chassis mounted in said torso;

two leg members each having a foot member mounted at the bottom end thereof, the top end of each leg member being movably mounted on said chassis;

a power source mounted on said chassis;

ambulatory transmission mechanism means operatively connecting said leg members to said power source for periodically moving said leg members vertically and angularly to propel said chassis sideways along a line connecting said foot members;

a toy tool operatively connected to said first arm member, said toy tool having a handle with a hole therein; and tool movement transmission mechanism means operatively connecting said power source and said toy for moving said tool, said tool movement transmission mechanism means comprising a rotatably mounted element operatively connected to said power source, said rotatably mounted element having an offset peg projecting therefrom and extending through the hole in said handle.

9. The toy of claim 8, wherein said toy tool is a toy broom having a plurality of resilient bristles extending therefrom, and further comprising a second arm member fixedly attached to said torso casing and having an opening in the hand end thereof through which the handle of said toy broom movably extends.

* * * * *